United States Patent [19]

MacBroom, Jr.

[11] 4,173,100

[45] Nov. 6, 1979

[54] CANNULA GRINDING CARTRIDGE AND FIXTURE

[75] Inventor: James MacBroom, Jr., Wolcott, Conn.

[73] Assignee: Toolmatic Corporation of Connecticut, North Branford, Conn.

[21] Appl. No.: 874,942

[22] Filed: Feb. 3, 1978

[51] Int. Cl.[2] ..... B24B 19/00

[52] U.S. Cl. ..... 51/227 H; 269/43

[58] Field of Search ..... 51/217 R, 227 H, 227 R, 51/219 R; 269/43

[56] References Cited

U.S. PATENT DOCUMENTS

| | | | |
|---|---|---|---|
| 2,429,357 | 10/1947 | Jacoby | 51/227 H |
| 3,855,738 | 12/1974 | Guggenheim | 51/217 R |
| 3,975,864 | 8/1976 | Glowacki | 51/165.87 |

*Primary Examiner*—Harold D. Whitehead

*Attorney, Agent, or Firm*—DeLio and Montgomery

[57] ABSTRACT

A cartridge for use in supporting and rotating tubes to be ground to produce cannulas. The cartridge includes support plates forming a clamp, the plates adapted to be shifted laterally with respect to each other to rotate the tubes clamped therebetween.

10 Claims, 5 Drawing Figures

27
52
31
41
35
34
32
33
29
30
48
40
42
5

CANNULA GRINDING CARTRIDGE AND FIXTURE

BACKGROUND OF THE INVENTION

1. Field of the Invention

This invention relates to grinding cannulas, and more particularly to apparatus for aligning and holding cannulas while they are ground.

2. Description of the Prior Art

As described in U.S. Pat. No. 3,975,864, cannulas are formed by grinding the ends of small tubes to provide a primary bevel or lance point, and two secondary bevels or lancets on both sides of the lance point. The lancets are formed by rotating the tubes to allow the lancet cuts to be made.

Since a large number of tubes are ground simultaneously, the individual tubes must be properly aligned in the apparatus. Presently, a multiplicity of the tubes are aligned prior to being mounted in a fixture on the grinding apparatus. The aligned tubes are secured on a strip of tape which serve to hold the tubes in the selected orientation while they are being mounted onto the grinding fixture. After grinding, the tubes are removed from the fixture still on the tape. The tubes are separated from the tape and placed in containers for storage or shipment.

The use of tape in aligning and mounting the tubes in a fixture on the grinding apparatus is time-consuming and wasteful. After one set of tubes is ground, the strip of tape holding them cannot be re-used. Furthermore, a number of tubes might become dislodged and disoriented before they could be secured in the grinding apparatus, resulting in improperly ground tubes or expenditure of time in realignment.

The present invention provides a cartridge to be used in conjunction with a grinding apparatus that can be loaded with tubes and hold them in the proper orientation prior to mounting on the grinding apparatus. The cartridge also is arranged to permit the tubes to rotate so that lancet cuts may be made.

SUMMARY OF THE INVENTION

Briefly stated, the invention in one form thereof provides a cartridge for holding tubes and adapted to be clamped in a grinding fixture. The cartridge includes a rear support member, a fore support member, a privot means which also allows the fore and rear support members to shift laterally with respect to each other, and biasing means proximate one edge of the cartridge for urging the distal edges of the support members together.

It is an object of this invention to provide a new and improved apparatus in removable cartridge form for holding and supporting metal tubes to be ground as cannulas.

It is a further object to provide a cartridge adapted to be loaded with metal tubes to facilitate proper mounting onto a grinding fixture.

BRIEF DESCRIPTION OF THE DRAWINGS

The features of the invention which are believed to be novel are particularly pointed out and distinctly claimed in the concluding portion of this specification. The invention, however, both as to its organization and operation, together with further objects and advantages thereof may best be appreciated by reference to the following detailed description taken in conjunction with the drawings, wherein:

DETAILED DESCRIPTION OF THE PREFERRED EMBODIMENT

Figures 1, 2, 5:
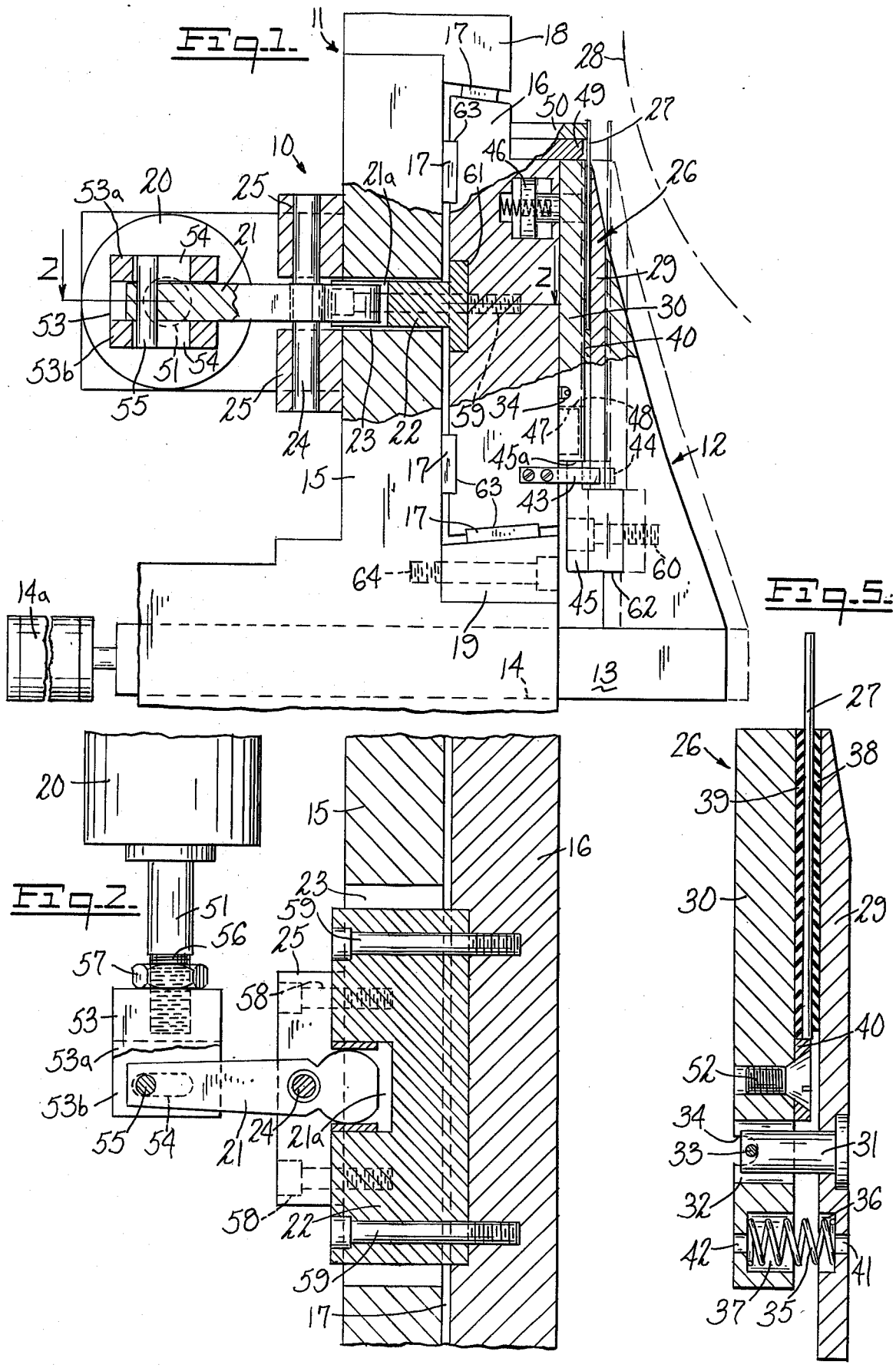
FIG. 1 is a side elevational view, partially in section, of a grinding machine with which a cartridge according to the invention may be used.
FIG. 2 is a view in section taken along lines 2—2 in FIG. 1.
FIG. 5 is a sectional view taken along lines 5—5 in FIG. 3.

As exemplified in FIGS. 1 and 2, the invention may be used in a grinding fixture 10 which generally comprises a rear support 11 and a forward support 12. Forward support 12 rides on a leg 13 which slides in a guideway 14 in rear support 11. The separation between forward support 12 and rear support 11 may be varied by moving leg 13 in relation to guideway 14 by conventional means, exemplified by a hydraulic actuating device 14*a*.

Rear support 11 includes a fixed support 15, and a shiftable plate 16 relatively movable with respect to the fixed support on bearings 17. An upper beveled member 18 and a lower beveled member 19 maintain plate 16 and support 15 at a predetermined spacing.

Plate 16 may be linearly shifted relative to support 15 by an actuating device 20 through lever 21. The lever engages a recess 21*a* in a T-shaped member 22 attached to the rear of plate 16 through aperture 23 in support 15. The lever 21 is pivotal about a pivot 24, which is supported by brackets 25 affixed to support 15.

A cartridge 26 embodying the invention is adapted to be clamped between movable plate 16 and forward support 12. The cartridge 26 supports workpieces 27 which are to be ground by a grinding wheel 28 (represented by broken lines).

Figures 3, 4:
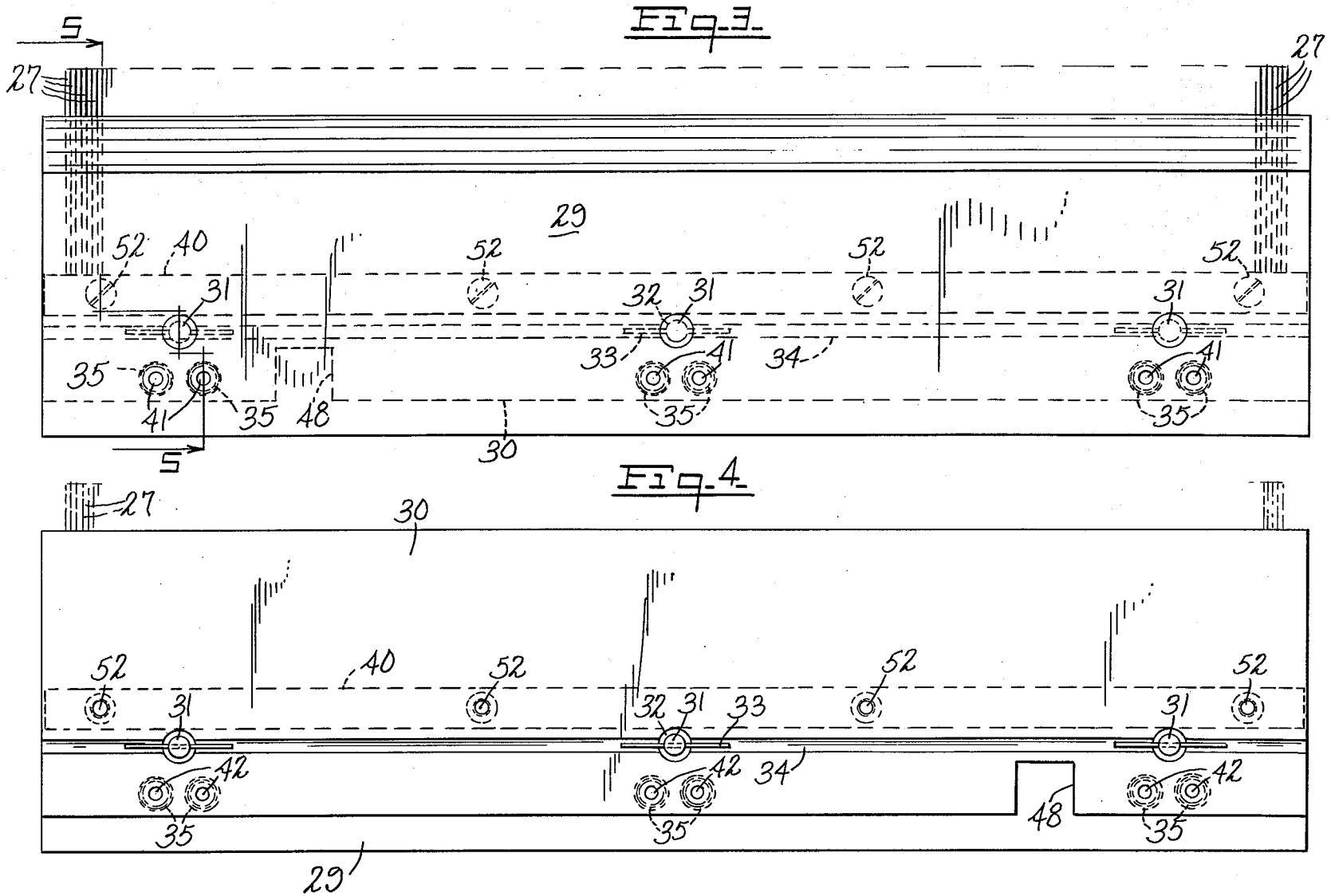
FIG. 3 is a front view of a cartridge according to the invention.
FIG. 4 is a rear view of a cartridge according to the invention.

As exemplified in FIGS. 3, 4 and 5, cartridge 26 includes a forward plate 29 and a rear plate 30. Pins 31 extend from forward plate 29 through a rear plate 30 through bores 32. Bores 32 have a larger diameter than pins 31. A locking pin 33 extends through each pin 31 and rests in a groove 34 in the rear surface of rear plate 30. Pins 33 act as pivots for plate 30, with respect to plate 29.

Cartridge 26 further includes spring members 35 seated in respective recesses 36 and 37 in plates 29 and 30.

Plate 29 is beveled at the upper end to avoid contact with the grinding wheel when the cartridge is in fixture 10.

The clearance of the pins 31 in bores 32 permits relative lateral movement of plates 29 and 30. It will be noted from FIG. 4 that plate 29 extends below the bottom edge of plate 30.

Workpieces 27 are held vertically (as shown in FIGS. 3, 4 and 5) between the opposing faces of plates 29 and 30, cushioned by resilient frictional layers 38 and 39, respectively. The lower ends of workpieces 27 abut a stop 40 attached to plate 30. The stop determines the elevation of workpieces 27 in cartridge 26, and may be varied in size for cannulas of various lengths.

Each of the recesses 36 and 37 have apertures 41 and 42 formed therein to guide the counterbore.

In operation, the lower end plates 29 and 30 of cartridge 26 are squeezed together to separate the upper edges of plates 29 and 30. Workpieces 27 in the form of small tubes of uniform length are fed into the cartridge between the separated plates by a vibrator and reside therein in vertical side-by-side touching relation on stop 40. The pressure on the lower portion of cartridge 26 is then relieved, and the springs bias and hold plates 29 and 30 closed, clamping the workpieces between the plates. Frictional layers 38 and 39 hold the workpieces tightly against motion relative thereto.

Cartridge 26 is then ready for insertion in fixture 10. Leg 13 advances support 12 to the right as shown in FIG. 1. The cartridge is inserted into the fixture 10 rearwardly of support 12 between stops 43 and 44 extending forwardly from plate 16. Stops 43 and 44 prevent plate 29 from shifting movement in the machine, but are positioned below the lower edge of plate 30. Cartridge 26 is supported by a lower support 45 fixed to support 12. A spring loaded plunger 46 extending from plate 16 contacts the rear surface of plate 30 to help maintain cartridge 26 upright against support 12.

Leg 13 then retracts (to the left as shown in FIG. 1) support 12 to securely clamp cartridge 26 between support 12 and plate 16. A projection 47 extending from the front of plate 16 engages a notch 48 in rear plate 30 of cartridge 26. The upper edge of plate 30 is positioned under an upper stop 49 and the free ends of workpieces 27 abut a reinforcing brace 50. When the forward support is fully retracted, the lower portion of plate 29 is blocked laterally in both directions by stops 43 and 44.

Fixture 10 is particularly adapted for plunge grinding of workpieces 27. Reinforcing brace 50 prevents the free ends of workpieces 27 from being forced rearwardly by the grinding wheel.

After the primary (lance) cut is made, fixture 10 rotates the workpieces to provide for forming the lance cuts. The shaft 51 of actuating device 20 advances downwardly (as shown in FIG. 2), pivoting lever 21 counterclockwise about pivot 24. This shifts T-shaped member 22 and plate 16 sideways (upwardly, as shown in FIG.2). Stud 47 forces plate 30 to shift with plate 16. The forward plate 29 is held stationary by support 12 by the frictional force between proximate surfaces thereof. The frictional layer 39 shifts with plate 30, and the two frictional layers 38 and 39 cooperate to rotate workpieces 27. Grinding wheel 28 then makes the first lancet cut.

Workpieces 27 are then rotated in the other direction to form the second lancet cut. Actuating device 20 retracts shaft 51 (upwardly as shown in FIG. 2), causing the lever 21 to pivot clockwise and shift T-shaped member 22 and plate 16 sideways in the other direction (downwardly as shown in FIG. 2). Rear plate 30 and its associated frictional layer 39 shift with plate 16. Since forward plate 29 and frictional layers 38 are again held stationery, workpieces 27 are rotated in the opposite direction from the first rotation. Grinding wheel 28 then makes the second lancet cut.

Leg 13 and support 12 are then advanced to allow the cartridge to be removed from fixture 10. Lip 45*a* and plunger 46 urge the cartridge to move forwardly with the support. When the cartridge is past short stop 43, it may be slid out of the fixture. Workpieces 27 may be removed by applying pressure to the bottom of the cartridge, separating the upper edges of plates 29 and 30.

To allow forward plate 29 and rear plate 30 to move sideways with respect to each other, bores 34 should be larger than the portion of pins 31 extending therethrough. Stop 40 may be affixed to plate 30 by means of a flat head machine screw 52, or may be made integrally therewith. If the stop is a separate piece, stops of different widths may be used depending on the length of the workpiece.

The locations of pins 33 along pins 31 are selected so that, when the plates 29 and 30 are biased closed on workpieces 27, the frictional layers 38 and 39 are in uniform contact with the workpieces along the lengths thereof.

Actuating device 20 may be a hydraulically or pneumatically operated cylinder with a piston shaft 51. Shaft 51 ends in a channel-shaped bracket 53 having legs 53*a* and *b* extending above and below lever 21. The bracket has slots 54 in the legs engaged by a pin 55 extending through lever 21. The slots permit reciprocal motion of the pin as the shaft is advanced and retracted to pivot the lever. The bracket 53 is threaded onto a threaded portion 56 of shaft 51. The position of bracket 53 may be finely adjusted by rotating shaft 51, advancing or retracting the bracket along thread 56. A nut 57 locks the bracket at a selected position on shaft 51.

Brackets 25, T-shaped member 22, and support 45 may be formed integrally with respective members 15, 16 and 12, or may alternately be affixed thereto by machine screws 58 through 60, as shown in FIGS. 1 and 2. The T-shaped member 22 and support 45 are set into insets 61 and 62 in respective plate 16 and support 12.

Bearings 17 may be strip bearings or roller bearings and may be set into insets 63 in plate 16.

Lower beveled member 19 is affixed to fixed support 15 by machine screws 64. Member 19 is preferably made removable to allow the easy mounting or removal of plate 16 to fixture 10.

An exemplary material for frictional layers 38 and 39 is a hard rubber.

The cartridge can be used in plunge grinding as exemplified or with a grinding machine where the grinding wheel traverse grinds a plurality of cannulas, as disclosed in U.S. Pat. No. 3,975,864.

It may thus be seen that the objects set forth above as well as those made apparent from the preceding description are efficiently attained. While a preferred embodiment of the invention has been set forth for purposes of disclosure, it is to be understood that other embodiments of the invention as well as modifications to the disclosed embodiment which do not depart from the spirit and scope of the invention may become apparent to those skilled in the art. Accordingly, the appended claims are intended to cover all embodiments and modifications of the invention which do not depart from the spirit and scope of the invention.

What is claimed is:

1. A cartridge for holding a multiplicity of cannulas in side-by-side relation for grinding comprising, a base plate and a facing cover plate, a plurality of spaced apart springs interposed between said plates adjacent one end thereof and urging the other ends thereof together, means defining a shoulder for the ends of cannulas between said plates and intermediate said ends, and means connecting said plates between said springs and said other ends and permitting pivotal movement of said plates with and against the force of said springs and also permitting small relative longitudinal movement of said plates in a direction essentially perpendicular to the directed force of said springs.

2. For use in an apparatus for grinding tubes to produce cannulas, a cartridge for releasably holding tubes comprising a first support plate and a second support plate, said support plates having opposing support surfaces, means defining at least one aperture in said first support plate, a pin extending from said second support plate through said at least one aperture, said pin having a smaller diameter than said aperture whereby said first support plate and said second support plate can be shifted laterally with respect to each other, pivot means cooperating with said pin about which said second support plate pivots, and biasing means forcing said support surfaces together.

3. A cartridge as defined in claim 2 wherein each of said support surfaces has a frictional layer thereon.

4. A cartridge as defined in claim 2 wherein said pivot means comprises a second pin extending transversely through said first pin, said second pin being disposed in a groove in the distal surface of said second plate.

5. A cartridge as defined in claim 2 wherein said biasing means comprises a spring compressively engaging said support plates.

6. A cartridge as defined in claim 2 further comprising a shoulder situated on one of said support surfaces against which the ends of the workpieces abut.

7. In an apparatus for grinding tubes to produce cannulas, a fixture for holding said tubes comprising rear support means including a fixed support and a laterally shiftable support, a forward support facing said shiftable support and spaced therefrom at a variable spacing, and a cartridge adapted to be clamped between said shiftable support and said forward support for holding the tubes to be ground, said cartridge comprising a forward plate and a rear plate relatively laterally shiftable with respect to each other, said plates having opposing support surfaces, biasing means interposed between said plates forcing said support surfaces together, and means connecting said plates between said biasing means and said support surfaces and permitting pivotal movement of said plates in a direction essentially perpendicular to the directed force of said biasing means.

8. A fixture as defined in claim 7 wherein said shiftable support includes means engaging the rear plate.

9. A fixture as defined in claim 7 wherein said forward support includes a lower support having a lip forming a channel adapted to receive the lower edge of said forward plate.

10. A fixture as defined in claim 7 wherein said shiftable plate includes an upper stop, two sideways stops and a reinforcing brace for bracing the ends of the tubes when they are ground.

* * * * *